US008211353B2

(12) United States Patent
Dee et al.

(10) Patent No.: US 8,211,353 B2
(45) Date of Patent: Jul. 3, 2012

(54) FIBER SPINNING PROCESS USING A WEAKLY INTERACTING POLYMER

(75) Inventors: Gregory T. Dee, Wilmington, DE (US); Joseph Brian Hovanec, Richmond, VA (US); Jan Van Meerveld, Howald (LU)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/553,578

(22) Filed: Sep. 3, 2009

(65) Prior Publication Data

US 2010/0059907 A1 Mar. 11, 2010

Related U.S. Application Data

(60) Provisional application No. 61/191,103, filed on Sep. 5, 2008.

(51) Int. Cl.
*D06M 10/00* (2006.01)
*H05B 7/00* (2006.01)

(52) U.S. Cl. ..... 264/465; 264/85

(58) Field of Classification Search ..... 264/85, 264/465

See application file for complete search history.

(56) References Cited

U.S. PATENT DOCUMENTS

| | | | | |
|---|---|---|---|---|
| 2005/0187605 | A1 | 8/2005 | Greenhalgh et al. | |
| 2006/0049542 | A1 * | 3/2006 | Chu et al. | 264/465 X |
| 2006/0097431 | A1 | 5/2006 | Hovanec | |
| 2007/0018361 | A1 * | 1/2007 | Xu | 264/465 |

FOREIGN PATENT DOCUMENTS

| | | | |
|---|---|---|---|
| WO | WO 03/080905 | | 10/2003 |
| WO | WO-2006017360 | A1 * | 2/2006 |
| WO | WO 2006/066025 | | 6/2006 |
| WO | WO 2007/022390 | | 2/2007 |
| WO | WO 2007/062393 | | 5/2007 |

OTHER PUBLICATIONS

PCT International Search Report and Written Opinion for International Application No. PCT/US2009/056181 dated Sep. 8, 2009.

* cited by examiner

*Primary Examiner* — Leo B Tentoni

(57) ABSTRACT

A fiber spinning process comprising the steps of providing a polymer solution, which comprises at least one weakly interacting polymer dissolved in at least one weakly interacting solvent to a spinneret; issuing the polymer solution in combination with a blowing gas in a direction from at least one spinning nozzle in the spinneret and in the presence of an electric field; forming fibers and collecting the fibers on a collector.

23 Claims, 1 Drawing Sheet

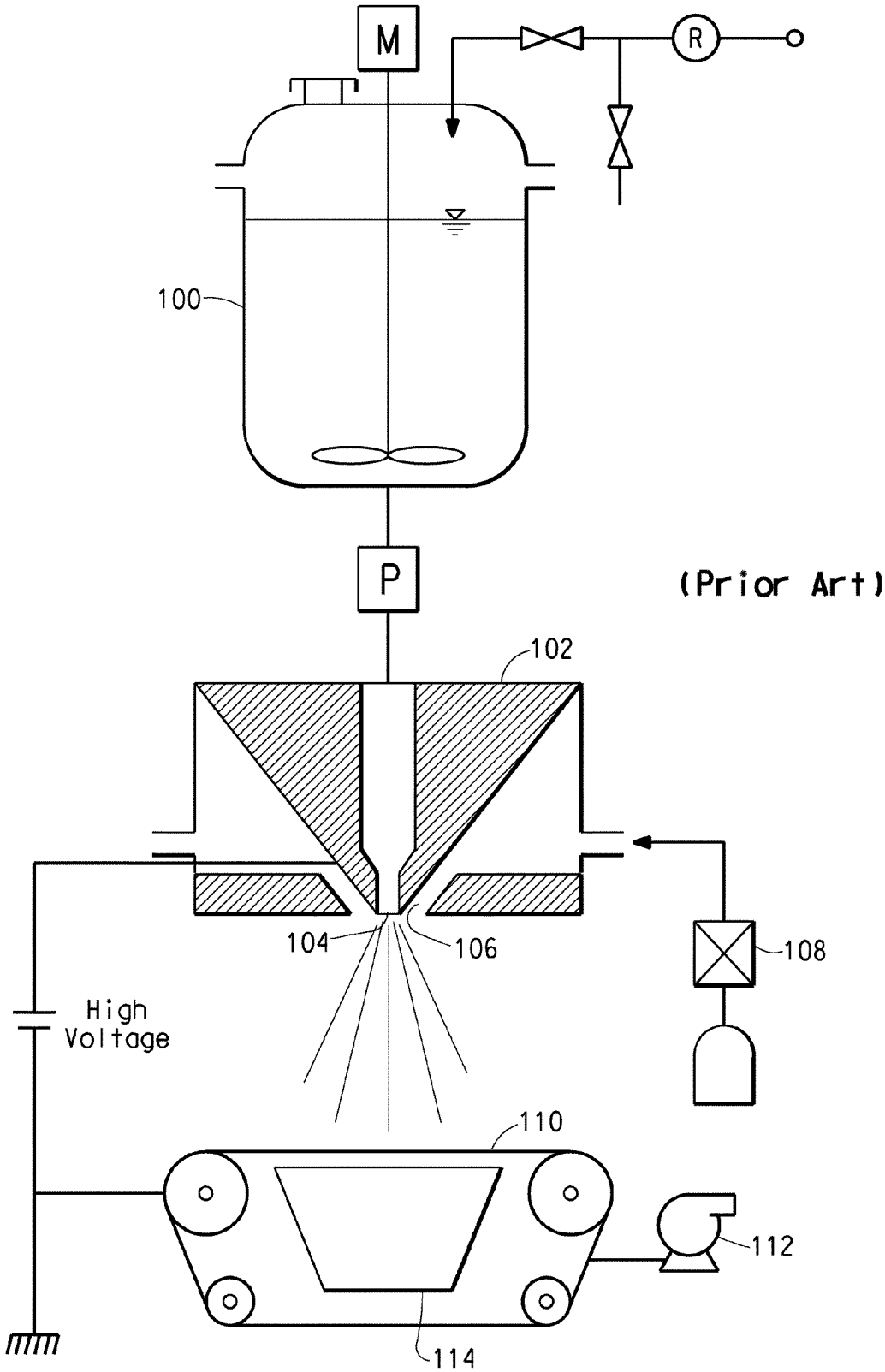
M
R
100
P
(Prior Art)
102
104
106
108
High
Voltage
110
112
114

FIBER SPINNING PROCESS USING A WEAKLY INTERACTING POLYMER

CROSS REFERENCE TO RELATED APPLICATIONS

Subject matter disclosed herein may be disclosed and claimed in the following application filed concurrently herewith, assigned to the assignee of the present invention:

"High Throughput Electroblowing Process", Ser. No. 61/191,102, filed in the names of Dee, Hovanec, and VanMeerveld.

BACKGROUND OF THE INVENTION

1. Field of the Invention

The present invention relates to a process for forming a fibrous web from an electroblowing process using a weakly interacting polymer in a polymer solution with low electrical conductivity.

2. Description of the Related Art

Solution spinning processes are frequently used to manufacture fibers and nonwoven fabrics, and in some cases have the advantage of high throughputs, such that the fibers or fabrics can be made in large, commercially viable quantities. These processes can be used to make fibrous webs that are useful in medical garments, filters and other end uses that require a selective barrier. The performance of these types of fibrous webs can be enhanced with the utilization of fibers with small diameters.

A type of solution spinning called electrospinning produces very fine fibers by spinning a polymer solution through a spinning nozzle in the presence of an electric field. However, to take advantage of the electric field, the polymer solution must be conductive. Weakly interacting polymers dissolved in weakly interacting solvents provide polymer solutions that have low electrical conductivity and, therefore, unsuitable for electrospinning. What is needed is a solution spinning process utilizing an electric field that can produce fibers made from weakly interacting polymers.

SUMMARY OF THE INVENTION

The present invention is a fiber spinning process comprising: providing a polymer solution, which comprises at least one weakly interacting polymer having a dielectric constant less than about 3 dissolved in at least one weakly interacting solvent having a dielectric constant less than about 3 to a spinneret; issuing the polymer solution in combination with a blowing gas in a direction from at least one spinning nozzle in the spinneret and in the presence of an electric field; forming fibers and collecting the fibers on a collector.

BRIEF DESCRIPTION OF THE DRAWINGS

The accompanying drawing, which is incorporated in and constitutes a part of this specification, and together with the description, serves to explain the principles of the invention.

FIG. 1 is a schematic of a prior art electroblowing apparatus useful for preparing a fibrous web according to the invention.

DETAILED DESCRIPTION OF THE INVENTION

There is a need for fibrous products made from a wide variety of polymers to suit various customer end-use needs. Many polymeric fibers and webs can be formed from electrospinning conductive polymer solutions. However, weakly interacting polymers dissolved in weakly interacting solvents provide polymer solutions that have low electrical conductivity and, therefore, unsuitable for electrospinning.

Solutions with low electrical conductivity cannot be electrospun because such solutions cannot move charge from the spinneret electrode to the surface of the solution thread line on the time scale of the process. The relaxation time ($\tau_e$) for charge neutralization in a conductor is given by the expression ($\tau_e=\kappa\in_0/\sigma$), where $\kappa$ is the dielectric constant of the solution, $\in_0$ is the permittivity of free space ($8.854\times10^{-12}$ farads/m), and $\sigma$ is the electrical conductivity. A typical relaxation time for this process is 0.1 to 0.3 seconds. Relaxation times higher than this range correspond to a charge that cannot redistribute itself in the solvent fast enough. Hence, we do not expect solvents having electrical conductivities less than about $10^{-12}$ S/m or dielectric constants less than about 3 to be suitable for electrospinning. The Table below shows the electrical conductivities, dielectric constants, and charge relaxation times computed using the above expression for a list of typical polymer solvents. The list is divided into solvents above the line with electrical conductivity suitable for electrospinning and solvents below the line with low electrical conductivity unsuitable for electrospinning.

TABLE

| Solvent | Conductivity (S/m) | Dielectric Constant (20 C.) | Relaxation Time (s) |
|---|---|---|---|
| formic acid | 6.08E−03 | 5.85E+01 | 8.52E−08 |
| 2,2,2 Trifluoroethanol | 7.00E−05 | 2.67E+01 | 3.38E−06 |
| DMF N,N-dimethylformamide | 6.00E−06 | 3.67E+01 | 5.41E−05 |
| water | 5.89E−06 | 7.84E+01 | 1.18E−04 |
| acetone | 4.90E−07 | 2.09E+01 | 3.77E−04 |
| 2-butanone (MEK) | 3.60E−07 | 1.85E+01 | 4.55E−04 |
| DMAc N,N-Dimethylacetamide | 5.00E−07 | 3.78E+01 | 6.69E−04 |
| ethanol | 1.35E−07 | 2.46E+01 | 1.61E−03 |
| methanol | 1.50E−07 | 3.27E+01 | 1.93E−03 |
| dichloromethane | 4.30E−09 | 8.93E+00 | 1.84E−02 |
| n-heptane | 1.00E−12 | 1.90E+00 | 1.68E+01 |
| toluene | 8.00E−14 | 2.38E+00 | 2.63E+02 |
| n-hexane | 1.00E−14 | 1.89E+00 | 1.67E+03 |
| n-heptane (Ultra Pure) | 1.00E−14 | 1.92E+00 | 1.70E+03 |
| decalin | 1.00E−14 | 2.15E+00 | 1.90E+03 |
| benzene | 4.43E−15 | 2.27E+00 | 4.54E+03 |
| methylcyclohexane | 5.00E−15 | 2.02E+00 | 3.58E+03 |
| cyclohexane | 7.00E−16 | 2.02E+00 | 2.56E+04 |

It is known that the addition of a weakly interacting polymer having dielectric constants less than about 3 to the solution further reduces the electrical conductivity. It is believed that this increases the solution viscosity which lowers the mobility of the ionic species in solution which are responsible for the measured electrical conductivity.

The present invention uses an electroblowing process to spin a weakly interacting polymer from a polymer solution with low electrical conductivity into fibers and webs.

The process for making commercial quantities and basis weights of fiber layer(s) is disclosed in International Publication Number WO2003/080905 (U.S. Ser. No. 10/822,325), which is hereby incorporated by reference. FIG. 1 is a schematic diagram of an electroblowing apparatus useful for carrying out the process of the present invention using electroblowing (or "electro-blown spinning") as described in International Publication Number WO2003/080905. This prior art electroblowing method comprises feeding a solution of a polymer in a solvent from a storage tank 100, through a spinneret 102, to a spinning nozzle 104 to which a high voltage is applied, while compressed gas or blowing gas is directed toward the polymer solution through a blowing gas nozzle 106 as the polymer solution exits the spinning nozzle 104 to form fibers, and collecting the fibers into a web on a grounded collector 110 under vacuum created by vacuum chamber 114 and blower 112. The fibers can be used in either continuous or discontinuous form.

The collection apparatus is preferably a moving collection belt positioned within the electrostatic field between the spinneret 102 and the collector 110. After being collected, the fiber layer is directed to and wound onto a wind-up roll on the downstream side of the collector 110. Optionally, the fibrous web can be deposited onto any of a variety of porous scrim materials arranged on the moving collection belt, such as spunbonded nonwovens, meltblown nonwovens, needle punched nonwovens, woven fabrics, knit fabrics, apertured films, paper and combinations thereof.

Optionally, a secondary gas can contact the fibers downstream from the spinneret to help drive off solvent from the fiber. When electroblowing fibers with a high throughput rate, large quantities of solvent must be removed from the fiber forming polymer solution. The secondary gas can be positioned to impinge the fibers or can be used as a sweeping gas to help remove solvent from the general spinning area.

The polymers of the present invention are weakly interacting polymers having a dielectric constant of less than about 3. These polymers interact via weak dispersion forces. These polymers generally include hydrocarbon polymers. Examples of hydrocarbon polymers suitable for the present invention include polyolefins, polydienes and polystyrene. Examples of polyolefins include polyethylene, polypropylene, poly(1-butene), poly(4-methyl-1-pentene), and blends, mixtures and copolymers thereof. Typically at least one of these polymers, more typically only one of these polymers at a time is utilized in the process of the present invention.

Suitable solvents that may be used to dissolve the polymers of the invention include weakly interacting solvents having a dielectric constant of less than about 3. These solvents interact via weak dispersion forces. A solvent for a polymer may be found by selecting a solvent with a solubility parameter similar to that of the polymer. A typical class of weakly interacting solvents is hydrocarbon solvents. Examples of hydrocarbons are pentane, hexane, heptane, octane, decane, cyclohexane, methylcyclohexane, benzene, toluene, xylene and decalin. Examples of polymer spinning solutions include polyethylene dissolved in solvents of p-xylene or decane, polypropylene dissolved in solvents of p-xylene or methylcyclohexane, poly(4-methyl-1-pentene) dissolved in solvents of methylcyclohexane or cyclohexane, and polystyrene dissolved in toluene or decaline.

The polymer solution can be spun at discharge rate through the spinning nozzle of the spinneret between about 0.1 to about 100 ml/min/hole, more advantageously between about 1 to about 100 ml/min/hole, still more advantageously between about 6 to about 100 ml/min/hole and most advantageously between about 10 to about 100 ml/min/hole.

The blowing gas can be selected from the group of air, nitrogen, argon, helium, carbon dioxide, hydrocarbons, halocarbons, halohydrocarbons and mixtures thereof. The blowing gas is injected at a flow velocity of about 50 to about 340 m/sec and a temperature from about ambient to about 300° C.

The fibers produced have a number average fiber diameter preferably less than 1,000 nanometers, more preferably less than 800 nanometers and most preferably less than 500 nanometers. The fibers can have an essentially round cross section shape.

The electric field can have a voltage potential of about 10 to about 100 kV. The electric field can be used to create a corona charge.

The fibers can be collected into a fibrous web comprising continuous, round cross section, weakly interacting polymer fibers having a number average fiber diameter less than about 1,000 nanometers.

The secondary gas can be selected from the group of air, nitrogen, argon, helium, carbon dioxide, hydrocarbons, halocarbons, halohydrocarbons and mixtures thereof. The secondary gas is injected at a flow velocity of about 50 to about 340 m/sec and a temperature from about ambient to about 300° C.

TEST METHODS

Fiber Diameter was determined as follows. Two to three scanning electron microscope (SEM) images were taken of each fine fiber layer sample. The diameter of clearly distinguishable fine fibers were measured from the photographs and recorded. Defects were not included (i.e., lumps of fine fibers, polymer drops, intersections of fine fibers). The number average fiber diameter from about 50 to 300 counts for each sample was calculated.

EXAMPLES

The fiber examples below were prepared using the general process and apparatus described above with the specific changes as noted below.

Example 1

An 8 wt % solution of a poly(4-methyl-1-pentene) (DX820) having a dielectric constant of 2.1, available form Mitsui Chemical, was dissolved in methylcyclohexane using a reflux condenser. A magnetic stirrer was used to agitate the hot solution. The homogeneous solution was transferred to a sealed glass container and transported to the spin chamber. The solution was transferred into the reservoir of the spin chamber and sealed. A spinneret with a 0.4064 mm inside diameter single spinning nozzle was used. A drum collector was used to collect the sample. The spinneret was placed at a negative potential of 100 kV. The collector was grounded. The distance from the spinning nozzle exit to the collector surface was 35 cm. Air was used for the blowing gas. Nitrogen was used for the secondary gas to control the relative humidity (RH) and the temperature in the spin chamber. The flow of nitrogen was sufficient to prevent the concentration of the solvent vapor in the spin chamber from exceeding the lower explosion limit. The RH was controlled to be less than 10%. The spin chamber temperature was close to 25° C. for the duration of the experiment. A nitrogen pressure of 0.377 MPa was used to maintain a solution flow rate of 1.6 ml/min/hole. The blowing gas was controlled to maintain an exit velocity on the order of 150 m/sec. The blowing gas temperature was close to 25° C. Once the solution flow was initiated, fiber was visible in the plume. Fiber was deposited in a swath on the drum. The number average fiber diameter of the fibers was measured to be 391 nanometers.

Example 2

A 9 wt % solution of a polystyrene (DOW 685D) having a dielectric constant of 2.5, available form DOW, was dissolved in toluene using a reflux condenser. A magnetic stirrer was used to agitate the hot solution. The homogeneous solution was transferred to a sealed glass container and transported to the spin chamber. The solution was transferred into the reservoir of the spin chamber and sealed. A spinneret with a 0.4064 mm inside diameter single spinning nozzle was used. A drum collector was used to collect the sample. The spinneret was placed at a negative electrical potential of 100 kV.

The drum collector was grounded. The distance from the spinning nozzle exit to the collector surface was 51 cm. Air was used for the blowing gas and for the secondary gas to control the RH and the temperature in the spin chamber. The RH was controlled to be less than 20%. The spin chamber temperature was close to 26° C. for the duration of the experiment. A nitrogen pressure of 0.135 MPa was used to maintain a solution flow rate of 1.27 ml/min/hole. The blowing gas was controlled to maintain an exit velocity on the order of 85 m/sec. The blowing gas temperature was close to 26° C. Once the solution flow was initiated, fiber was visible in the plume. Fiber was deposited in a swath on the drum. The number average fiber diameter of the fibers was measured to be 403 nanometers.

Example 3

An 11 wt % solution of Engage 8400 (an ethylene octene copolymer) having a dielectric constant of 2.2, available from DuPont, was dissolved in methylcyclohexane using a reflux condenser. A magnetic stirrer was used to agitate the hot solution. The homogeneous solution was transferred to a sealed glass container and transported to the spin chamber. The solution was transferred into the reservoir of the spin chamber and sealed. A spinneret with a 0.4064 mm inside diameter single spinning nozzle was used. A drum collector was used to collect the sample. The spinneret was placed at a negative potential of 100 kV. The collector was grounded. The distance from the spinning nozzle exit to the collector surface was 30 cm. Air was used for the blowing gas. Nitrogen was used for the secondary gas to control the RH and the temperature in the spin chamber. The flow of nitrogen was sufficient to avoid the concentration of the solvent vapor in the spin chamber exceeding the lower explosion limit. The RH was controlled to be less than 9%. The spin chamber temperature was close to 29° C. for the duration of the experiment. A nitrogen pressure of 0.308 MPa was used to maintain a solution flow rate of 12.6 ml/min/hole. The blowing gas was controlled to maintain an exit velocity on the order of 156 m/sec. The blowing gas temperature was close to 28° C. Once the solution flow was initiated, fiber was visible in the plume. Fiber was deposited in a swath on the drum. The number average fiber diameter of the fibers was measured to be 502 nanometers.

The lack of polymer solution conductivity would generally make these polymer solutions difficult to electrospin. However, by using the blowing gas available in electroblowing, these types of polymer solutions can be electroblown into fibers. The presence of the blowing gas provides a significant role in the development of fibers. The presence of the electrical field helps the fibers to repel one another and make a uniform web upon laydown of the fibers onto the collector.

What is claimed is:

1. A fiber spinning process comprising:

providing a polymer solution, which comprises at least one weakly interacting polymer having a dielectric constant less than about 3 dissolved in at least one weakly interacting solvent having a dielectric constant less than about 3, to a spinneret;

issuing the polymer solution in combination with a blowing gas in a direction away from at least one spinning nozzle in the spinneret and in the presence of an electric field;

forming fibers; and collecting the fibers on a collector;

wherein the polymer solution has a conductivity of less than about $10^{-12}$ S/m.

2. The process according to claim 1, wherein the weakly interacting polymer is a hydrocarbon polymer.

3. The process according to claim 2, wherein the hydrocarbon polymer is selected from the group consisting of polyolefins, polydienes and polystyrene.

4. The process according to claim 3, wherein the polyolefin is selected from the group consisting of polyethylene, polypropylene, poly(1-butene), poly(4-methyl-1-pentene), and blends, mixtures and copolymers thereof.

5. The process according to claim 1, wherein the weakly interacting solvent is a hydrocarbon.

6. The process according to claim 5, wherein the hydrocarbon is selected from the group consisting of pentane, hexane, heptane, octane, decane, cyclohexane, benzene, toluene, xylene and decaline.

7. The process according to claim 1, wherein the polymer solution is discharged through the spinning nozzle at a discharge rate between about 0.1 to about 100 ml/min/hole.

8. The process according to claim 7, wherein the polymer solution is discharged through the spinning nozzle at a discharge rate between about 1 to about 100 ml/min/hole.

9. The process according to claim 8, wherein the polymer solution is discharged through the spinning nozzle at a discharge rate between about 6 to about 100 ml/min/hole.

10. The process according to claim 9, wherein the polymer solution is discharged through the spinning nozzle at a discharge rate between about 10 to about 100 ml/min/hole.

11. The process according to claim 1, wherein the blowing gas is selected from the group of air, nitrogen, argon, helium, carbon dioxide, hydrocarbons, halocarbons, halohydrocarbons and mixtures thereof.

12. The process according to claim 1, wherein the blowing gas is injected at a flow velocity of about 50 to about 340 m/sec and a temperature from about ambient to about 300° C.

13. The process according to claim 1, wherein the fibers have a number average fiber diameter less than about 1000 nanometers.

14. The process according to claim 13, wherein the fibers have a number average fiber diameter less than about 800 nanometers.

15. The process according to claim 14, wherein the fibers have a number average fiber diameter less than about 500 nanometers.

16. The process according to claim 1, wherein the fibers have a cross section shape that is essentially round.

17. The process according to claim 1, wherein the electric field has a voltage potential of about 10 kV to about 100 kV.

18. The process according to claim 1, wherein the electrical field is a corona charging field.

19. The process according to claim 1, further comprising contacting the fibers with a secondary gas located downstream from the spinneret.

20. The process according to claim 19, wherein the blowing gas is selected from the group of air, nitrogen, argon, helium, carbon dioxide, hydrocarbons, halocarbons, halohydrocarbons and mixtures thereof.

21. The process according to claim 19, wherein the blowing gas is injected at a flow velocity of about 50 to about 340 m/sec and a temperature from about ambient to about 300° C.

22. The process according to claim 1, wherein the polymer solution comprises just one weakly interacting polymer having a dielectric constant less than about 3.

23. The process according to claim 1, wherein the fibers are deposited on a porous scrim material as they are being collected.

* * * * *